US006598761B1

(12) United States Patent
Chou

(10) Patent No.: US 6,598,761 B1
(45) Date of Patent: Jul. 29, 2003

(54) BLADE HOLDER AND DISPENSER

(76) Inventor: Chi Tsun Chou, No. 108-24, Chong Chin Road, Bei Tun Chu, Taichung (TW), 406

( * ) Notice: Subject to any disclaimer, the term of this patent is extended or adjusted under 35 U.S.C. 154(b) by 34 days.

(21) Appl. No.: 10/061,205

(22) Filed: Feb. 4, 2002

(51) Int. Cl.[7] ..... B65H 1/08
(52) U.S. Cl. ..... 221/228; 221/232
(58) Field of Search ..... 221/56, 58, 45, 221/59, 228, 232, 226, 276, 279; 206/355, 208

(56) References Cited

U.S. PATENT DOCUMENTS 2,641,358 A * 6/1953 Santo ..... 221/232
3,650,433 A * 3/1972 Robertson ..... 221/65
4,826,042 A 5/1989 Vujovich ..... 221/228
4,850,512 A 7/1989 Vujovich ..... 221/232
5,251,783 A 10/1993 Gringer ..... 221/102

* cited by examiner

*Primary Examiner*—Kenneth W. Noland

(57) ABSTRACT

A blade holder includes a housing detachably secured onto a base plate. The base plate includes a panel engaged into a notch of the housing, and includes a slot communicating with the notch of the housing. The housing includes a channel for slidably receiving a pusher. The pusher includes a shank slidably received in the slot of the housing before the housing is secured onto the base plate, without additional driving tools and fasteners. A frame is slidably engaged in the housing for moving the blades toward the pusher which may then move the blades out of the housing.

6 Claims, 4 Drawing Sheets

BLADE HOLDER AND DISPENSER

BACKGROUND OF THE INVENTION

1. Field of the Invention

The present invention relates to a blade holder, and more particularly to a blade holder for holding the blades of the utility knives, and for dispensing the blades.

2. Description of the Prior Art

Various kinds of typical blade holders have been developed for holding the blades of the utility knives. U.S. Pat. No. 5,251,783 to Gringer discloses one of the typical blade holders for holding and receiving the blades of the utility knives therein. However, the blades may not be easily removed from the blade holders.

U.S. Pat. No. 4,826,042 to Vujovich, and U.S. Pat. No. 4,850,512 to Vujovich, disclose two of the other typical blade holders for holding the blades, and for allowing the blades to be easily removed from the blade holders. However, the blade holders comprise at least a front cover and a sliding plate that are required to be secured to the blade holders with additional fasteners and driving tools, such that the blade holders may not be easily manufactured and assembled.

The present invention has arisen to mitigate and/or obviate the afore described disadvantages of the conventional blade holders.

SUMMARY OF THE INVENTION

The primary objective of the present invention is to provide a blade holder for holding the blades of the utility knives, and for dispensing the blades.

The other objective of the present invention is to provide a blade holder including a structure to be easily manufactured and assembled without additional tools and fasteners.

In accordance with one aspect of the invention, there is provided a blade holder comprising a base plate including a rear portion having a panel extended upward therefrom, and including a peripheral portion, a housing including a plurality of catches detachably secured to the peripheral portion of the base plate for detachably securing the housing onto the base plate, the housing including a chamber formed therein for receiving blades therein, the housing including a rear portion having a notch formed therein for receiving the panel of the base plate, and including a slot formed therein and communicating with the notch and the chamber thereof, the housing including a channel formed therein and communicating with the chamber thereof, a pusher slidably received in the channel of the housing, and including an actuator for engaging with the blades and for moving the blades outward through the channel of the housing, the pusher including a shank extended therefrom and slidably received in the slot of the housing, and a frame slidably engaged in the chamber of the housing for moving the blades toward the pusher. The panel of the base plate may be engaged into the notch of the housing, and the housing may be secured onto the base plate with the catches, without additional fasteners and driving tools. In addition, the shank of the pusher may be engaged into the slot of the housing before the housing is engaged onto the base plate.

The pusher includes a knob extended from the shank thereof for moving the pusher relative to the housing.

The housing includes a groove formed therein and communicating with the channel thereof, the pusher includes a rib extended therefrom and slidably engaged in the groove of the housing.

The base plate includes a groove formed therein, the pusher includes a rib extended therefrom and slidably engaged in the groove of the base plate.

The housing includes two sides each having a limb extended downward therefrom, the limbs include the catches extended therefrom for engaging with the peripheral portion of the base plate.

The base plate includes a serrated surface formed thereon, the frame includes a projection extended therefrom and engaged with the serrated surface of the base plate for positioning the frame to the base plate.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
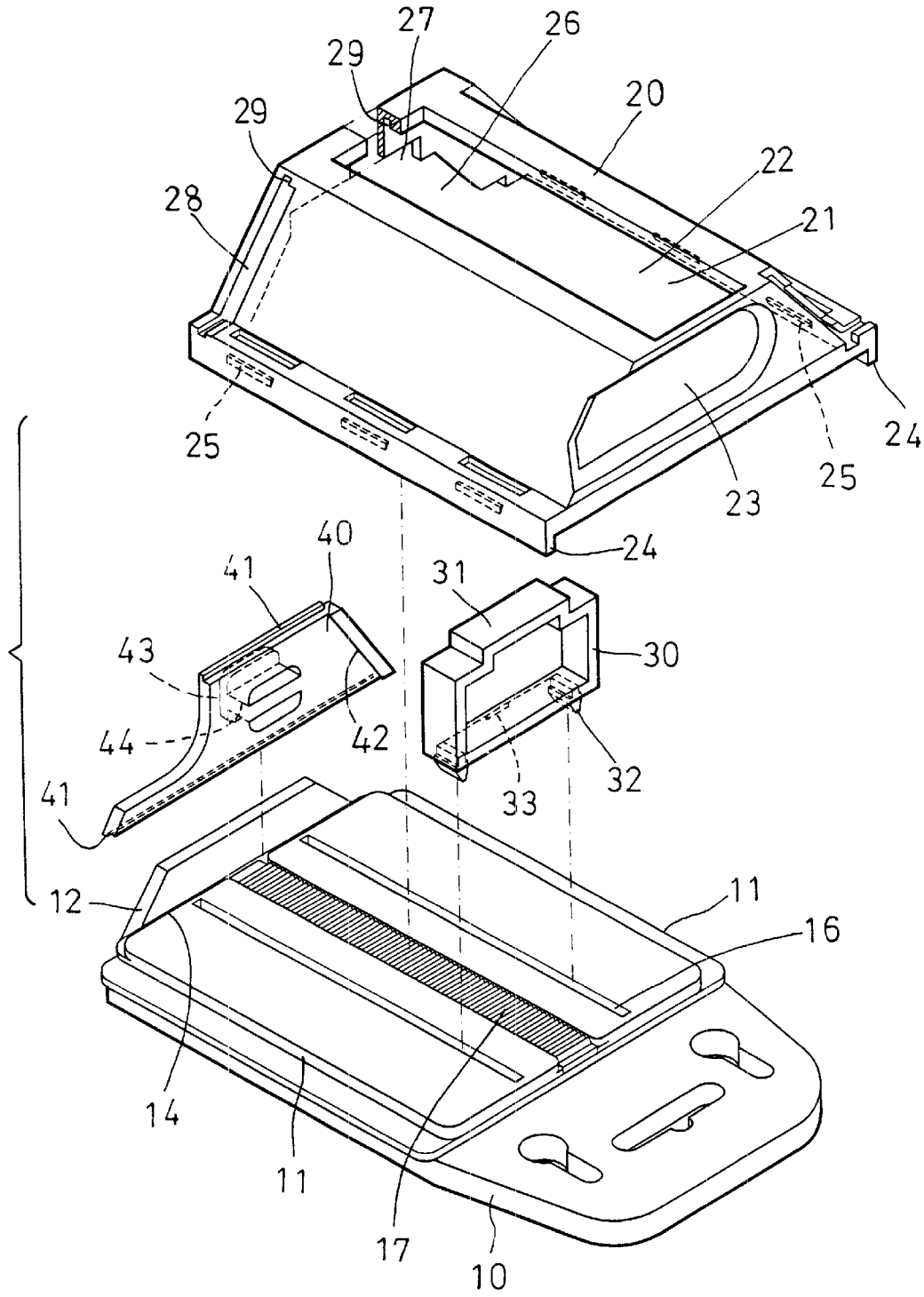
FIG. 1 is an exploded view of a blade holder in accordance with the present invention.

Referring to the drawings, and initially to FIGS. 1–6, a blade holder in accordance with the present invention comprises a base plate 10 including a pair of side flanges 11 extended laterally outward from the two opposite sides thereof, and including a substantially trapezoid panel 12 extended upward from the rear portion thereof, for example, and including a groove 14 formed therein, particularly formed beside the trapezoid panel 12 or formed between the trapezoid panel 12 and base plate 10. The base plate 10 includes one or more, such as two passages 16 formed therein, and parallel to the side flanges 11 thereof, and includes a serrated surface 17 formed between the passages 16 thereof.

A housing 20 includes a chamber 21 formed therein, and includes a conduit 22 formed in the upper portion thereof and an opening 23 formed in the front portion thereof and communicating with the chamber 21 thereof. The housing 20 includes two sides each having a downwardly extending limb 24 for engaging onto the side flanges 11 of the base plate 10, and includes one or more catches 25 extended from the limbs 24 for engaging with the side flanges 11 of the base plate 10 and for detachably securing the housing 20 to the base plate 10, without additional fasteners or driving tools.

Figure 6:
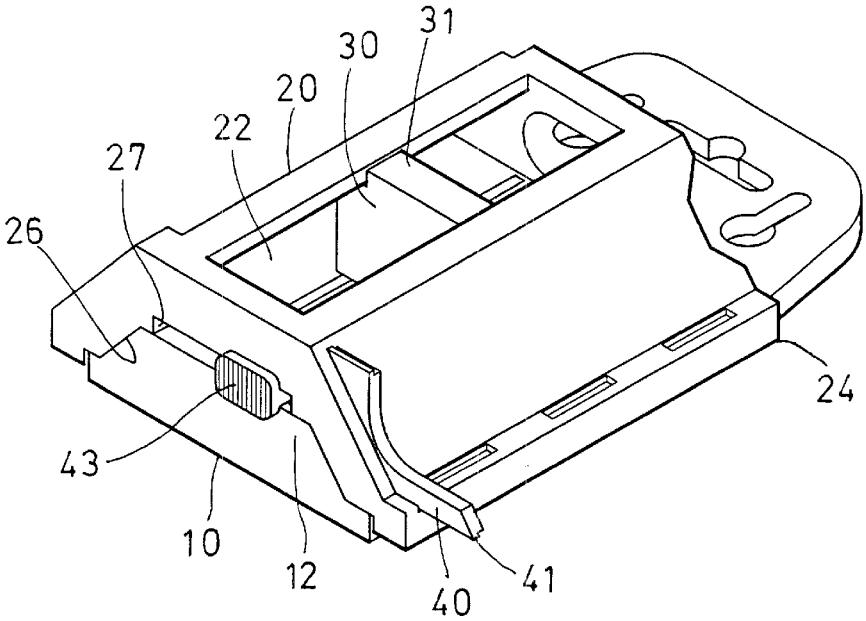
FIG. 6 is a perspective view of the blade holder, as viewing from the other angle or direction relative to that shown in FIG. 2.

The housing 20 includes a rear portion having a substantially trapezoid notch 26 formed therein corresponding to the shape of the trapezoid panel 12, for receiving the trapezoid panel 12. The housing 20 further includes a slot 27 formed therein, such as formed above the notch 26 thereof, and communicating with the notch 26 thereof. The housing 20 further includes a channel 28 formed therein, such as formed in the rear portion thereof, and communicating with the chamber 21 of the housing 20, and includes a groove 29 formed therein and communicating with the channel 28 thereof. As best shown in FIG. 6, the slot 27 may be formed between the trapezoid panel 12 and the housing 20 after the panel 12 is engaged into the notch 26 of the housing 20 and after the housing 20 has been secured onto the base plate 10.

A frame 30 is slidably received in the housing 20 and includes a bulge 31 extended upward therefrom and slidably engaged in the conduit 22 of the housing 20 for guiding the frame 30 to move relative to the housing 20, and includes one or more legs 32 extended downward therefrom and slidably engaged in the passages 16 of the base plate to (FIG. 5), for further stably guiding the frame 30 to slide relative to the housing 20 and the base plate 10. The frame 30 includes a projection 33 extended downward therefrom for engaging with the serrated surface 17 of the base plate 10 (FIG. 4), and for positioning the frame 30 to the base plate 10 and the housing 20 at any required position.

Figure 2:
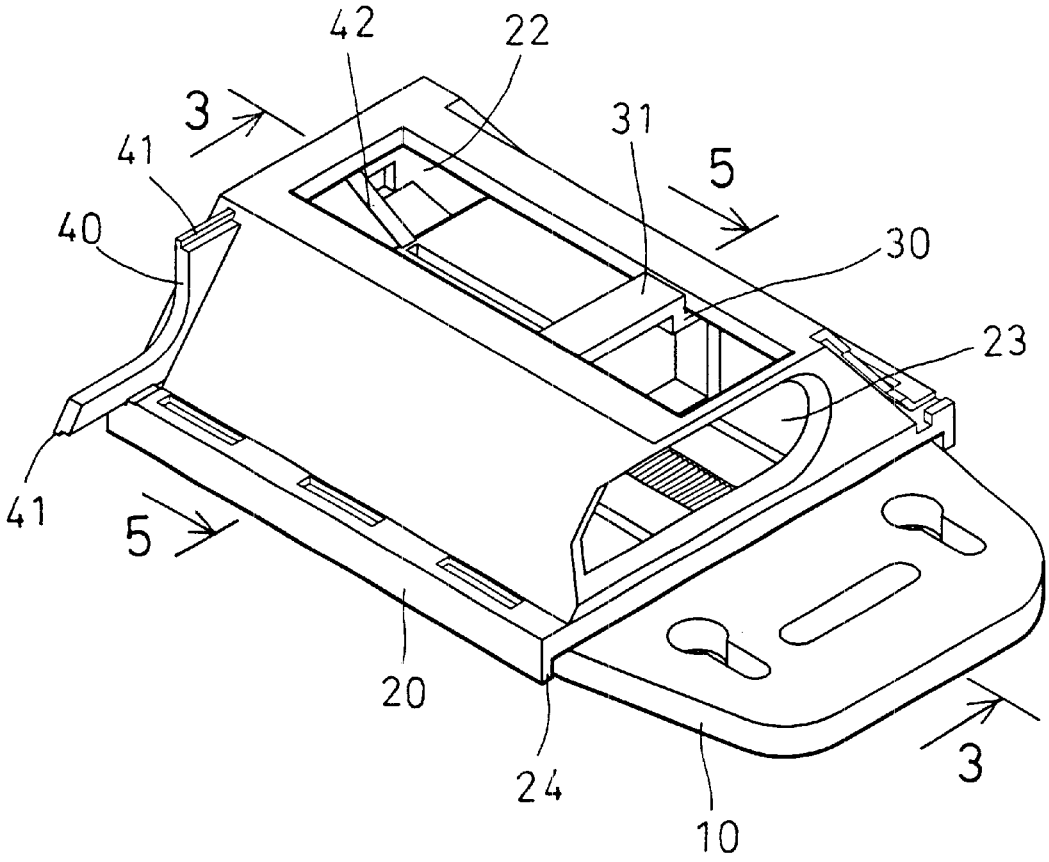
FIG. 2 is a perspective view of the blade holder.
Figure 3:
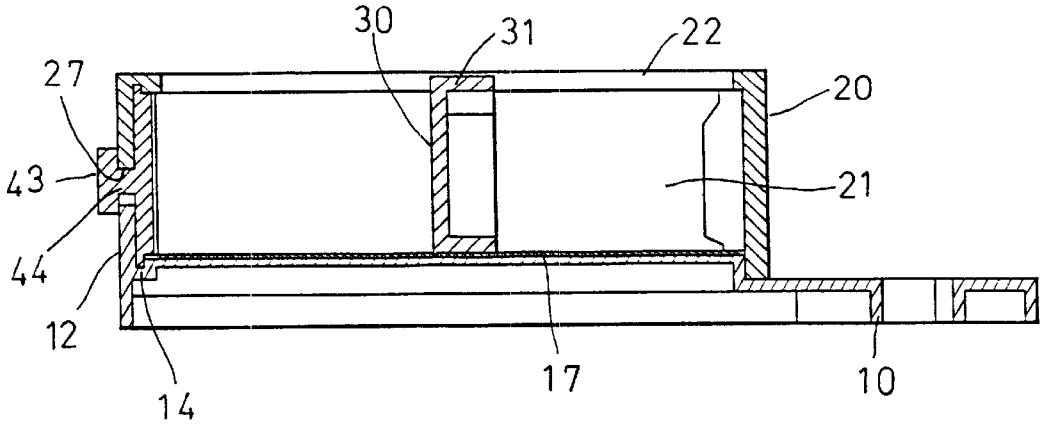
FIG. 3 is a cross sectional view taken along lines 3—3 of FIG. 2.
Figure 4:
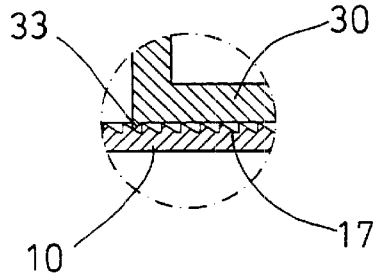
FIG. 4 is an enlarged partial cross sectional view of the blade holder as shown in FIG. 3.
Figure 5:
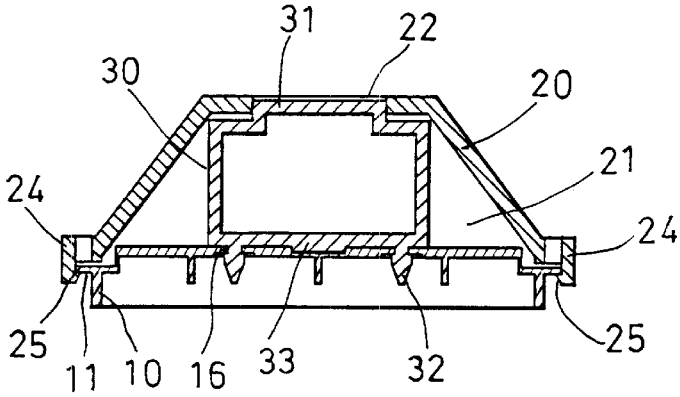
FIG. 5 is a cross sectional view taken along lines 5—5 of FIG. 2.
Figure 7:
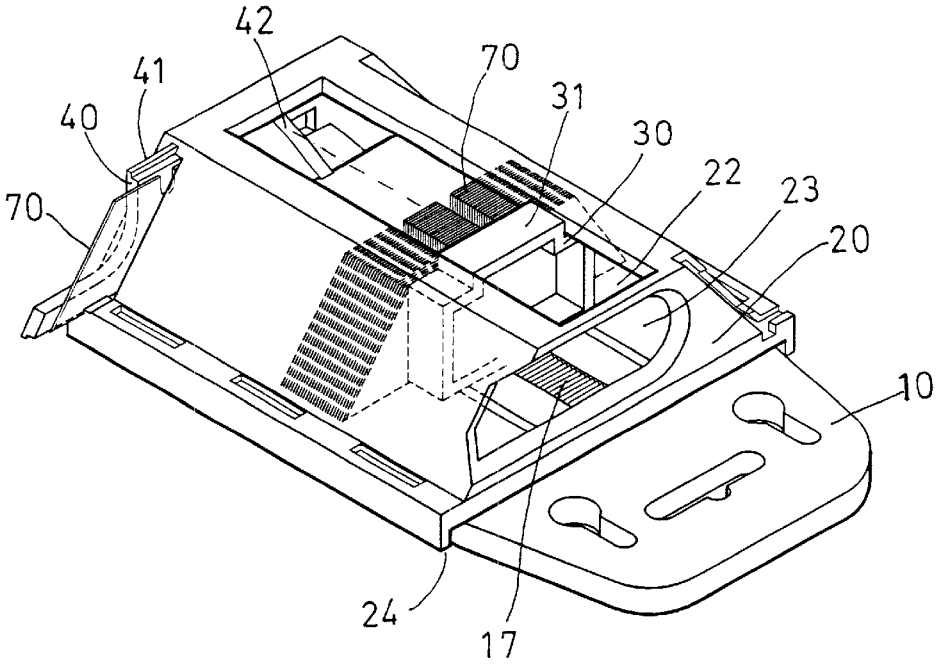
FIG. 7 is a perspective view similar to FIG. 2, illustrating the operation of the blade holder.

A pusher 40 is slidably engaged in the channel 28 of the housing 20, and includes an upper and a lower portions each having a rib 41 extended therefrom for engaging into the groove 29 of the housing 20 and the groove 14 of the base plate 10, and for stably guiding the pusher 40 to slide along the channel 28 of the housing 20 and to move inward and out ward of the housing 20 (FIGS. 2, 6, 7). The pusher 40 includes a bulge or an actuator 42 extended therefrom for engaging with the blades 70 and for moving the blade 70 outward through the channel 28 of the housing 20 (FIG. 7). The pusher 40 includes a knob 44 extended from a shank 43 and extended outward of the housing 20. The shank 43 is slidably engaged in the slot 27 of the housing 20.

It is to be noted that the shank 43 of the pusher 40 may be slidably and solidly received and engaged in the slot 27 of the housing 20 before the housing 20 is secured onto the base plate 10. The pusher 40 may thus be further solidly and slidably secured to the housing 20 and the base plate 10 with the sliding engagement of the shank 43 in the slot 27 of the housing 20, without additional fasteners or driving tools. In In operation, as shown in FIG. 7, the blades 70 may be received in the chamber 21 of the housing 20, and may be engaged between the frame 30 and the pusher 40. The user may push the frame 30 toward the pusher 40 in order to force the blades 70 against the pusher 40. The users may even engage his finger into the conduit 22 of the housing 20 for moving the frame 30 and for forcing the blades 70 toward and against the pusher 40. The actuator 42 of the pusher 40 may be engaged with one of the blades 70, and may be used to force the blade 70 out through the channel 28 of the housing 20, by moving the pusher 40 relative to the housing 20 with the knob 43. After one or more of the blades 70 have been removed from the housing 20, the frame 30 may then be used to move the other blades 70 toward and against the pusher 40.

Accordingly, the blade holder in accordance with the present invention may be used for holding the blades of the utility knives, and for dispensing the blades, and includes a structure to be easily manufactured and assembled without additional tools and fasteners.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A blade holder comprising:

a base plate including a rear portion having a panel extended upward therefrom, and including a peripheral portion, a housing including a plurality of catches detachably secured to said peripheral portion of said base plate for detachably securing said housing onto said base plate, said housing including a chamber formed therein for receiving blades therein, said housing including a rear portion having a notch formed therein for receiving said panel of said base plate, and including a slot formed therein and communicating with said notch and said chamber thereof, said housing including a channel formed therein and communicating with said chamber thereof, a pusher slidably received in said channel of said housing, and including an actuator for engaging with the blades and for moving the blades outward through said channel of said housing, said pusher including a shank extended therefrom and slidably received in said slot of said housing, and a frame slidably engaged in said chamber of said housing for moving the blades toward said pusher.

2. The blade holder according to claim 1, wherein said pusher includes a knob extended from said shank thereof for moving said pusher relative to said housing.

3. The blade holder according to claim 1, wherein said housing includes a groove formed therein and communicating with said channel thereof, said pusher includes a rib extended therefrom and slidably engaged in said groove of said housing.

4. The blade holder according to claim 1, wherein said base plate includes a groove formed therein, said pusher includes a rib extended therefrom and slidably engaged in said groove of said base plate.

5. The blade holder according to claim 1, wherein said housing includes two sides each having a limb extended downward therefrom, said limbs include said catches extended therefrom for engaging with said peripheral portion of said base plate.

6. The blade holder according to claim 1, wherein said base plate includes a serrated surface formed thereon, said frame includes a projection extended therefrom and engaged with said serrated surface of said base plate for positioning said frame to said base plate.

* * * * *